US005411083A

United States Patent [19]

Freiburger

[11] Patent Number: 5,411,083

[45] Date of Patent: May 2, 1995

[54] INFLATABLE WELL SEAL

[76] Inventor: Cletus N. Freiburger, 2820 Davenport St., Dubuque, Iowa 52001

[21] Appl. No.: 103,113

[22] Filed: Aug. 9, 1993

[51] Int. Cl.[6] ..... E21B 33/13

[52] U.S. Cl. ..... 166/187; 166/285; 285/18; 403/31

[58] Field of Search ..... 166/187, 122, 121, 285, 166/315; 137/68 R, 71; 285/18; 403/15, 31

[56] References Cited

U.S. PATENT DOCUMENTS 3,995,694 12/1976 Freiburger ..... 166/285
4,913,229 4/1990 Hearn ..... 285/18 X

*Primary Examiner*—William P. Neuder
*Attorney, Agent, or Firm*—Browdy and Neimark

[57] ABSTRACT

A method and apparatus for sealing wells utilizing an inflatable bag and an automatically separable coupler. An air compressor or other fluid source supplies a fluid to the inflatable bag via a hose connected to the bag by this coupler and a valve. The bag is lowered into the well and it is then inflated until the coupler separates thereby disconnecting the hose from the bag, thus allowing the hose and the coupler to be recovered and used again. The well is thus sealed by the inflated bag. Concrete or any other similar substance can then be deposited into the well to fill the cavity formed between the bag and the level of the ground. Once the bag has been inflated to cover the well opening, it is then disconnected from the hose and coupler. Disconnection is effected automatically by collapse of flexible gaskets which join the coupler and the valve.

15 Claims, 6 Drawing Sheets

FIG. 2
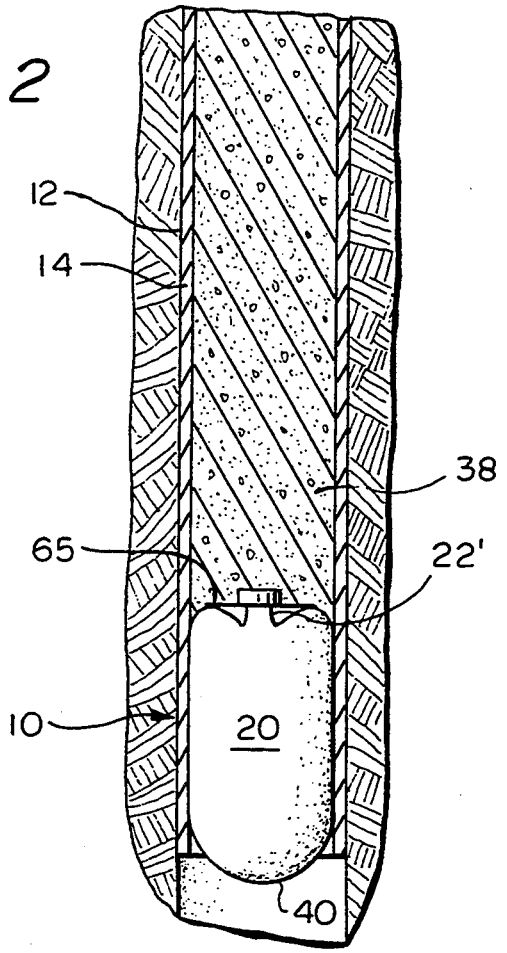
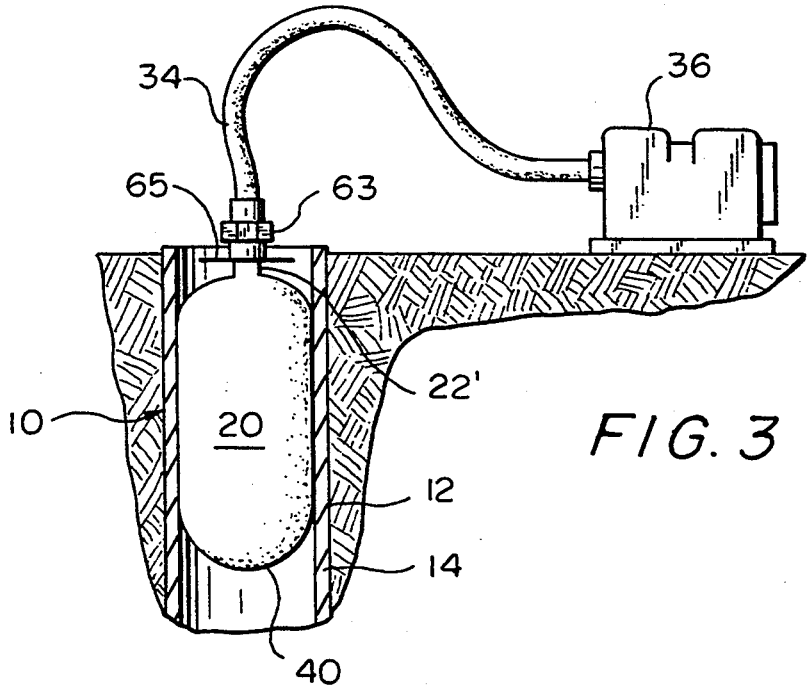
FIG. 3

INFLATABLE WELL SEAL

FIELD OF THE INVENTION

The present invention relates to an apparatus and method for either temporarily or permanently sealing water or other similar wells.

BACKGROUND OF THE INVENTION

In recent years the problem of abandoned wells in many areas of this country, particularly in the Midwest, has increased dramatically. Many years ago, the vast majority of the farms in operation in the Midwest were comparatively small, with each farm having its own well to provide for the individual farmer's water needs. However, due to the increased cost of farm machinery and other materials which are needed to adequately farm the land, many of these farms have been consolidated into larger and more efficient units. Since in many cases only one water system is needed to operate these larger farms, a large number of wells have become abandoned and in some cases polluted due to neglect.

If these abandoned wells are not adequately sealed, not only does the water contained therein become polluted, but also these wells pollute the water in adjoining operational wells. The abandoned wells can pollute these operational wells because the wells are usually connected by underground rivers or streams. Pollutants can enter these subterranean waterways by flowing down the unattended wells thereby polluting the water source used by functional wells in the immediate area.

Moreover, in more recent years many wells have become unsafe because of ground water contamination due to overuse of various types of pesticides including insecticides and herbicides, and in some sites mine acid run off, mine tailings contamination and/or even radioactive waste pollution. The underground waters, which can become polluted by spillage into abandoned wells or vice versa, service countless numbers of irrigation systems. If the water in those systems becomes polluted, crops cannot be safely produced and the soil can be permanently ruined. Furthermore, these underground rivers or streams can empty into above-ground rivers and streams thus polluting these water sources, also.

In addition, there is a continuing problem, particularly in the Midwest, of the ravages of flood damage which can pollute wells which are still in working order. Another problem in regard to abandoned wells is the danger of someone accidently falling into such a well thereby creating great risk of bodily injury or death.

Due to the great depth of some of these wells, and the fact that the bottom of the well shaft opens directly into the water source, it is quite impractical and nearly impossible to merely pour concrete or other hardenable substances into the well shaft to seal the well without first implanting a base structure in the shaft of the well. This base structure serves as a support for the hardenable material, and since the base is situated at a reasonably close distance to the top of the well, only a manageable amount of concrete need be used for filling the cavity formed between the base and ground level.

A device for solving these problems is shown in the Freiburger U.S. Pat. No. 3,995,694 which discloses an inflatable well seal using a releasable coupling. Such patent (also see attached FIG. 4) shows such a coupler 24 threaded internally at one end to fit a standard pipe thread which is on the outer surface of a valve stem 22 while the other end of the coupler 24 is threaded on the outside surface to engage an air hose 34 through the use of a standard inwardly threading coupling element 23 connected to the air hose 34. A gasket 59 is provided to ensure a tight fit between the stem 22 and the coupler 24. This coupler is fashioned of a plastic material well known in the art which can be constructed so that it breaks along a shear zone 26 of reduced thickness at predetermined internal pressure of the inflatable bag 20 such as 100 psi. At this pressure, the inflatable bag 20 will completely seal the well shaft. The coupler 24 contains a plurality of air holes 46 which allow the air to pass from the air hose 34 to the inflatable bag 20, through an orifice 54 located in the inflation valve stem 22.

A movable valve pin 42, which may be made of metal, is provided in the valve stem 22 which opens and closes orifice 54 thereby enabling the bag 20 to be filled with air and, when coupler 24 breaks, ensuring that air contained in the bag does not escape to the atmosphere but would remain in the bag 20. The valve pin 42 contains a substantially conical valve head 48 with the base portion 49 facing the interior of inflatable bag 20. The exterior surface 47 of the valve head 48 is adapted to be operatively engages with a valve seat 50 disposed on an annular flange which encircles the interior of valve stem 22. When the valve head 48 abuts against the valve seat 50, no air can enter or exit from the bag 20, but when the head 48 is not in contact with the seat 50, air may enter the bag 20 through orifice 54.

Coupler 24 also contains a valve pin 28 having a substantially cylindrical head 29. Valve pin 42 also contains a substantially cylindrical valve head 43 which cooperates with the valve head 29 of valve pin 28. When the coupler 24 is connected to the inflatable bag 20, the valve head 29 of the coupler 24 depresses valve head 43, thereby forcing the valve head 48 away from the valve seat 50. A compression spring 52 encircles the upper portion 56 of valve pin 42 between the head 13 of the valve pin 42 contained in valve stem 22 and the top portion 58' of flange 51. Therefore, before valve head 48 can be dislodged from valve seat 50, the force of this spring 52 must be overcome.

FIG. 5 attached depicts an automatically releasable coupler according to the an alternative embodiment of the Freiburger U.S. Pat. No. '694. This coupler 62, screw joined to the coupling element 23, is constructed without the shear zone 26 of coupler 24, but instead utilizing a pair of shear pins 60. A number of holes, corresponding to the number of shear pins used, are drilled or otherwise fashioned in the valve stem 22 and coupler 62 so that they align with one another. Therefore, the shear pins 60 provide for the attachment between the valve stem 22 and the coupler 62 and therefore no threading is between the valve stem 22 and the coupler 62 is needed for this connection. The shear pins 60 are then inserted into these holes thereby joining the stem 22 to the coupler 62. Thereafter, when the entire device is lowered into the well, these pins 60 will rupture when the internal pressure of the inflatable bag 20 reaches a predetermined level thereby releasing the coupler 62 from the stem 22.

The use of these constructions enables both the air hose 34 and the coupler 62 to be recovered and reused, but not without some difficultly for installation, and some possible damage upon removal thereof. Moreover, these constructions are more expensive than desirable because of the need to provide a threaded connection between the coupling element 23 and the coupler 24 or 62 so that the remnant of the coupler 24, 62 can be unscrewed and discarded after use, so the coupling element 23 can be reused.

SUMMARY OF THE INVENTION

It is accordingly an object of the present invention to overcome the deficiencies of the prior art, such as noted above.

Another object of the present invention is to provide an improved and simplified device for temporarily or permanently sealing a water well or similar well, or an abandoned well.

Another object of the present invention is to produce a device which adequately seals abandoned wells in a simple and economic manner.

A further object of the present invention is to produce a well-sealing device which utilizes a releasable coupler so that an air hose and the coupler can be recovered.

A still further object of the present invention is to produce a device that seals wells utilizing a releasable coupler which detaches from a seal when a predetermined pressure has been obtained.

Yet another object of the present invention is to provide a method for permanently or temporarily sealing an abandoned well.

These and other objects of the present invention are fulfilled by a simple and easy-to-use well seal tool utilizing an inflatable bag and an automatically releasable coupler. An air hose is connected to the bag by way of the coupler using a resiliently deformable connecting element, and this air hose is in communication with an air supply means such as an air compressor so that air can be introduced into the bag for purposes of inflation. When used in abandoned wells, the inflatable bag, coupling and air hose are lowered into the shaft of the well, and when inflated the bag frictionally grips the sides of the well shaft in order to remain in a fixed position in the shaft just as in the aforementioned Freiburger U.S. patent. When a predetermined pressure is reached in the interior of the bag, the bag acts against a loose washer and the coupler automatically releases by deformation of the deformable connecting element, thereby disconnecting the air hose from the inflatable bag. This enables the air hose and the coupler to be recovered so that they can be reused in a simplified manner to seal additional well shafts.

The present invention has a coupler which is constructed in a unitary piece. This unitary coupler reduces construction costs and allows for recovery of the entire coupler so that it can be reused without replacement.

This device may also be used to temporarily seal a well in a situation in which flood waters could possibly cause pollution in existing wells. The inflatable bag is lowered to just below the ground level and may be directly connected to the air hose. In this situation, the compressor inflates the bag and when the opening is completely sealed off, it is disconnected from the air hose either automatically or manually. Thus, when the danger of pollution has passed, the tube can be deflated and withdrawn from the well shaft.

BRIEF DESCRIPTION OF THE DRAWINGS

The foregoing and other objects and benefits of the invention will be described in greater detail below in conjunction with the drawings in which:

FIG. 2 is a diagrammatical view of the well seal after the air hose has been recovered and cement deposited into the bore.

FIG. 3 is a diagrammatical view of the well seal lowered for temporary sealing.

DESCRIPTION OF THE PREFERRED EMBODIMENT

Figure 1:
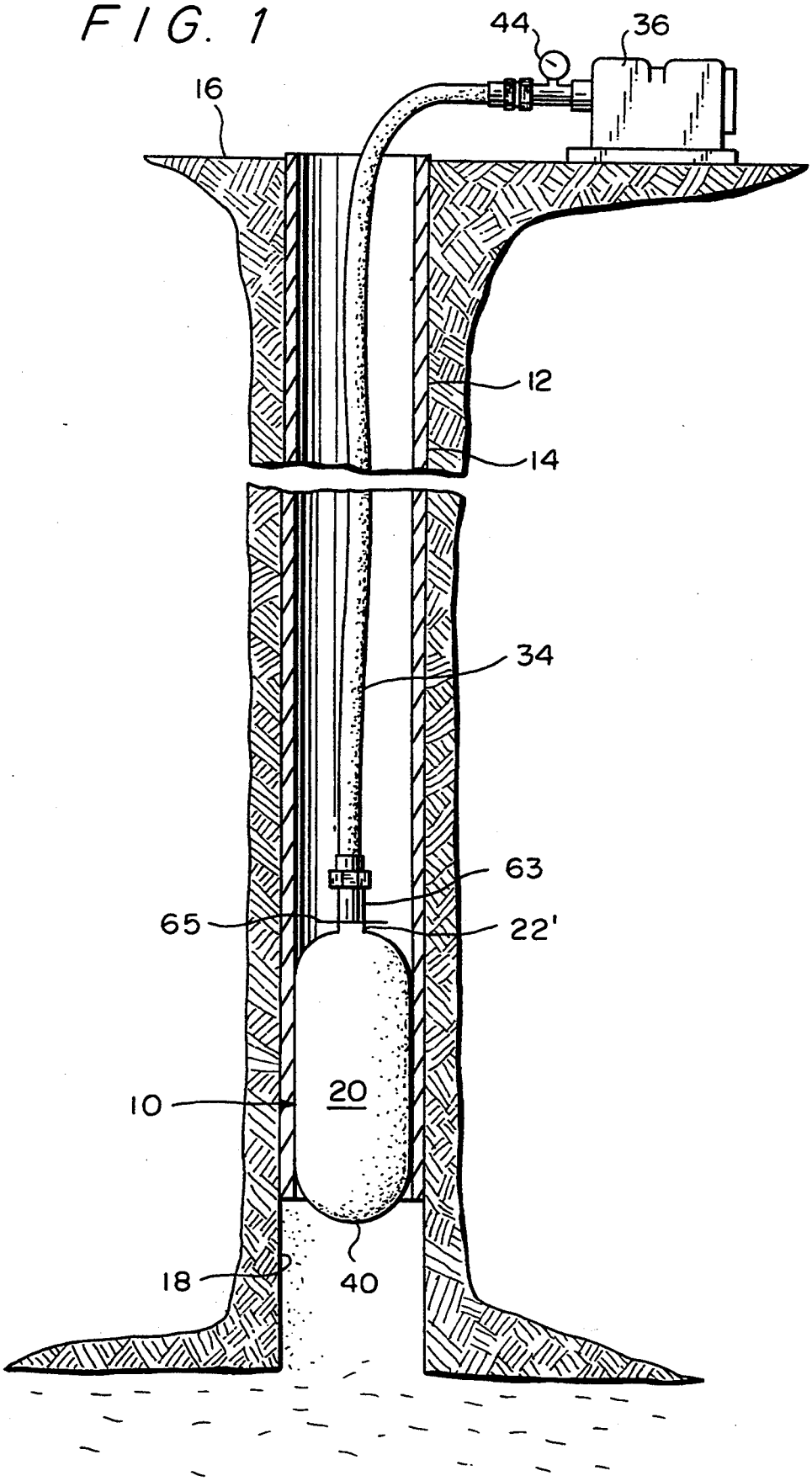
FIG. 1 is a diagrammatical view of the well seal lowered in an abandoned well.
Figure 4:
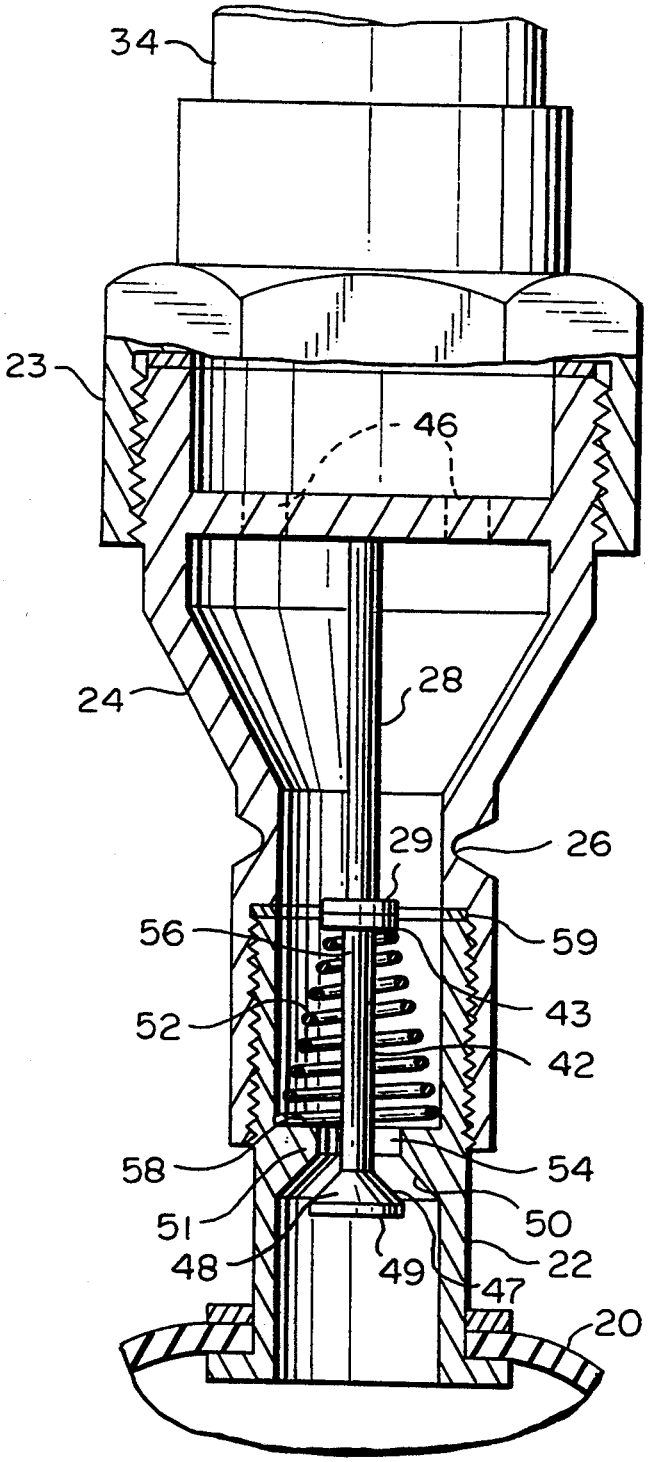
FIG. 4 PRIOR ART
FIG. 4 is a cross-sectional view of the releasable coupler and the valve stem according to the prior art.
Figure 5:
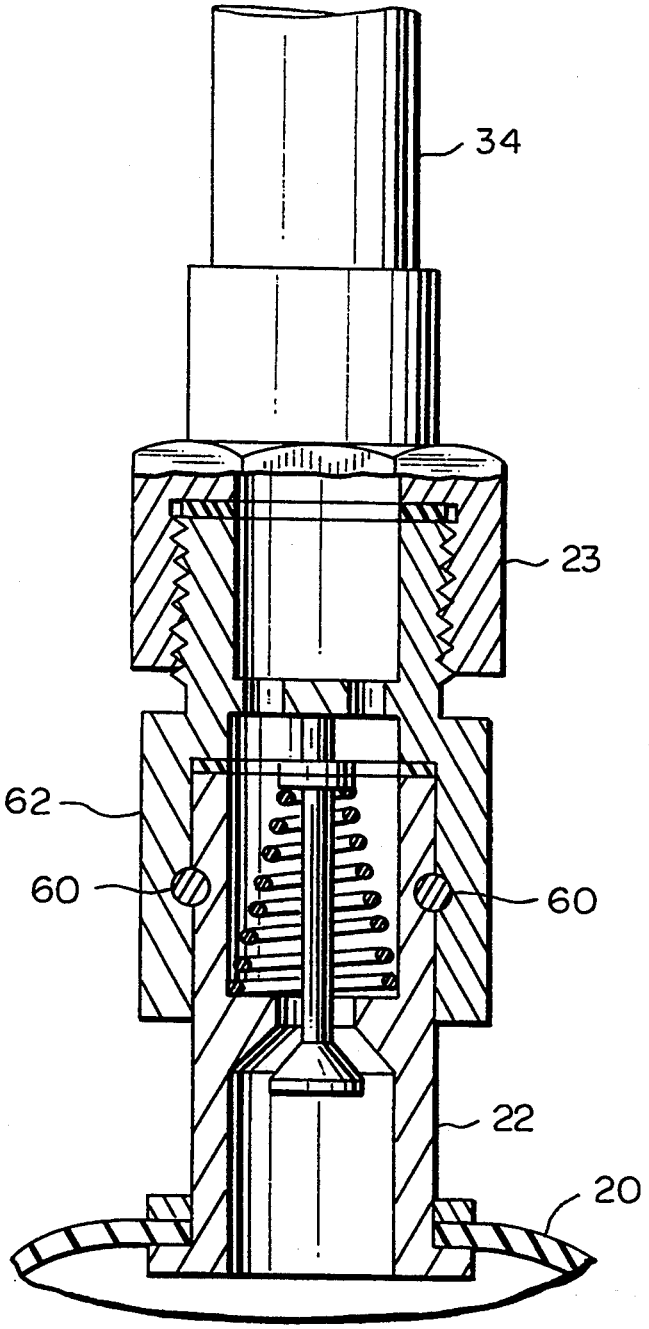
FIG. 5 PRIOR ART
FIG. 5 is a cross-sectional view of another embodiment of the releasable coupler according to the prior art.

FIG. 1 shows a well seal apparatus 10 after it has been lowered into an abandoned well shaft 12, inflated to seal the shaft, but before the releasing of a coupler 63. The apparatus includes an inflatable bag 20 of rubber or other similar elastomeric material which is generally cylindrical in configuration and has a closed lower end 40 and a valve stem 22' similar to a common inner tube valve. Although the exact dimensions of the inflatable bag 20 may be varied, a bag having dimensions of 2 feet in length and 8 inches in diameter performs quite satisfactorily. One end of an air hose 39 is connected to the valve stem 22' by means of the separable coupler 63, and the other end is connected to an air supply means 36 such as a compressor which is positioned at ground level 16 near the well shaft 12. The coupler is desirably constructed of a plastic material so that it can withstand substantial pressure, e.g. at least 100 and preferably at least 125 pounds of air pressure, or it can be made of metal.

FIG. 3 shows a slightly different embodiment used to temporarily seal an operating well in order to prevent contaminated water from flowing therein, e.g. in case of a flood. As shown in FIG. 3, the inflatable bag 20 may be connected to the air hose 39 with a coupler. The bag is lowered until it is only slightly below the ground level and then inflated by use of the air compressor 36 so as to seal the shaft opening, after which the air hose 39 is disconnected leaving a well with a temporary seal therein. When the flood waters have subsided, the bag 20 is deflated and then removed entirely from the well shaft 12.

Figure 6:
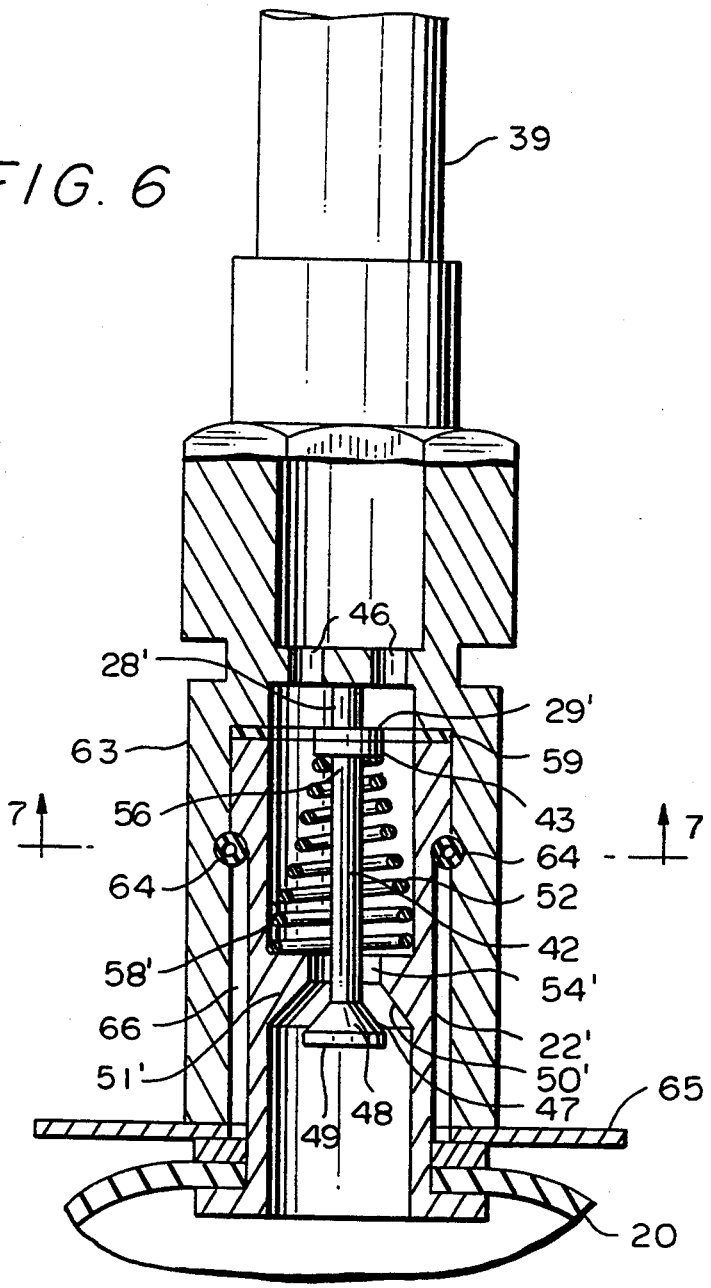
FIG. 6 is a cross-sectional view of a releasable coupler and the valve stem according to the present invention.

FIG. 6 shows an automatically releasable coupler according to the present invention which ensures an air tight fit between the stem 22' and the coupler 63, with the aid of a gasket 59. The coupler is fashioned of a plastic or metal material and is constructed as described below so that it separates from the valve stem 22' at an elevated internal pressure of the inflatable bag 20, such as 80–100 psi. At this pressure, the inflatable bag 20 will completely seal the well shaft. The coupler 63 contains a plurality of air holes 46, which allow the air to pass from the air hose 39 to the inflatable bag 20, through an orifice 54' located in the inflatable valve stem 22'. Coupler 63 also contains a valve pin 42 having a substantially cylindrical head 43, the function of which will be described in detail hereinbelow.

A movable valve pin 42, which may be made of metal, is provided in the valve stem 22' which opens and closes orifice 54' thereby enabling the bag 20 to be filled with air and, when coupler 63 separates from the valve stem 22', ensuring that air contained in the bag does not escape to the atmosphere but remains in the bag 20. The valve pin 42 contains a substantially conical valve head 48 with the base portion 49 facing the interior of inflatable bag 20. The exterior surface 47 of the valve head 48 is adapted to be operatively engaged with a valve seat 50' disposed on an annular flange which encircles the interior of valve stem 22'. When the valve head 48 abuts against the valve seat 50', no air can enter or exit from the bag 20, but when the head 48 is not in contact with the seat 50', air may enter the bag 20 through the orifice 54'.

The substantially cylindrical valve head 43 of the valve pin 42 which cooperates with the valve head 29' of valve pin 28'. When the coupler 63 is connected to the inflatable bag 20, the valve head 29' of the coupler 63 depresses valve head 43, thereby forcing the valve head 48 away from the valve seat 50'. A compression spring 52 encircles the upper portion 56 of the valve pin 42 in the valve stem 22' between the valve head 43 and the top surface or shoulder 58' of an inwardly directed annular flange 51'. Therefore, before valve head 48 can be dislodged from valve seat 50', the force of this spring 52, which normally biases the valve closed, must be overcome.

Figure 7:
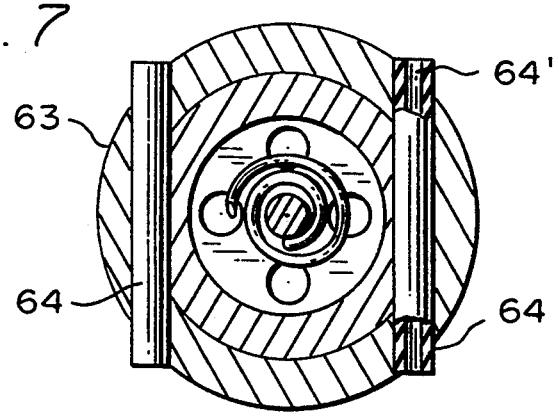
FIG. 7 is a sectional view of the releasable coupler taken through 9—9 of FIG. 6.

The coupler 63 of FIG. 6, unlike those of the prior art, is constructed without the shear zone 26 of coupling 24 and without the upper thread sections of couplers 24 and 62 which connect them to the coupling element 23. Coupler 63 uses a pair of elastomeric O-rings 64 to achieve the function of separating the coupler 63 from the stem 22'. A number of holes, corresponding to the number of O-rings used, are drilled or otherwise fashioned in valve stem 22' and the coupler 63 so that they align with one another, such as shown in FIG. 7. A loose washer 65 is located between the coupler 63 and the valve stem 22'. The interior diameter of the washer 65 is large enough so as to easily slide upwardly on and along the exterior surface of the valve stem 22'. When the entire device is lowered into the well and the bag 20 inflated as described below, the O-rings 64 will collapse and no longer hold the coupler 63 and the valve stem 22' together; i.e., when the internal pressure of the inflatable bag 20 reaches a predetermined level, it expands against the loose washer 65 thus driving the coupler 63 upwardly and releasing the coupler 63 from the stem 22'. The use of this type of arrangement enables both the air hose 39 and the coupler 63 to be recovered and reused without any damage thereto.

Figure 8:
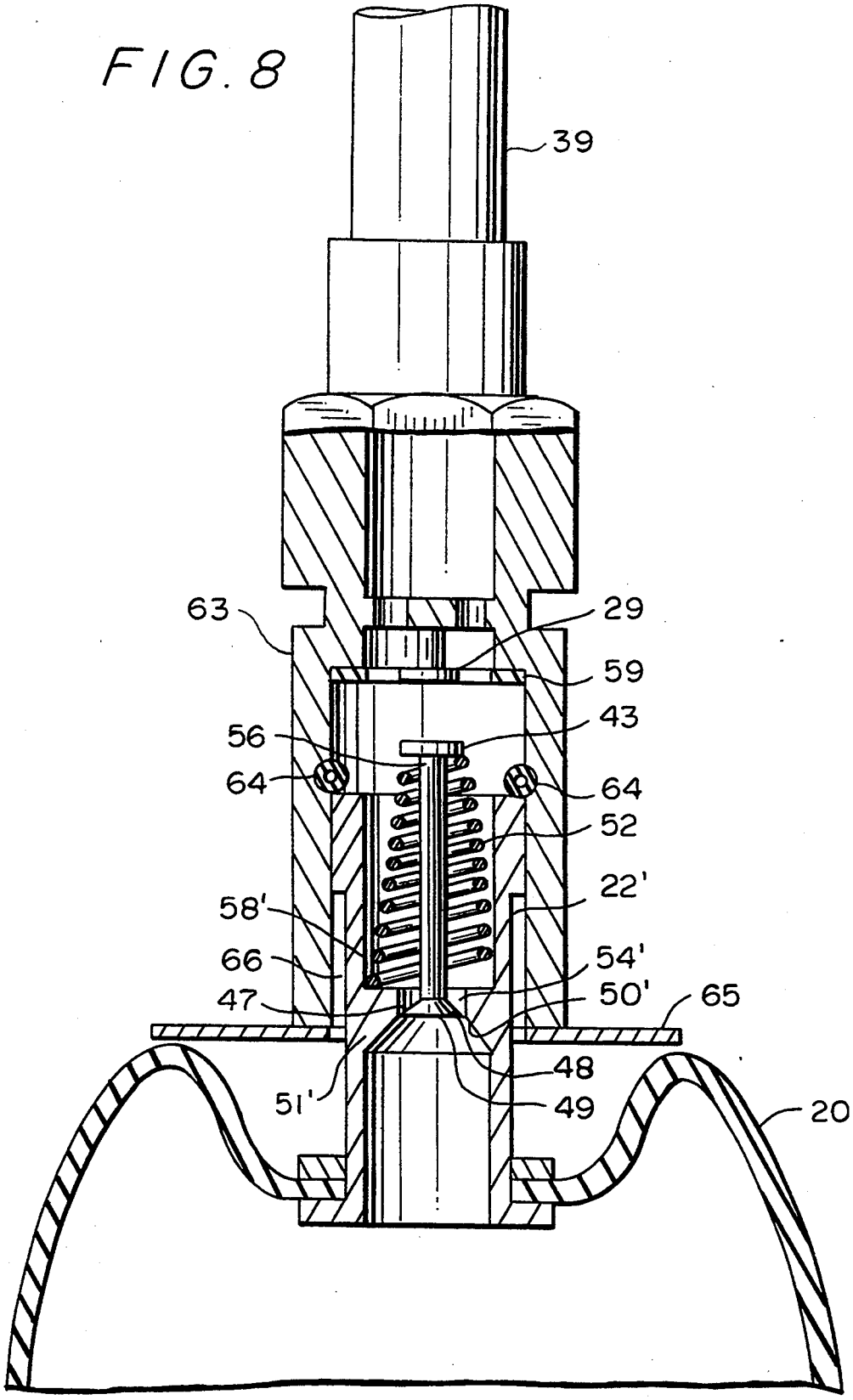
FIG. 8 is a cross-sectional view of a releasable coupler being separated from the valve stem according to the present invention.

The operation of the inflatable well seal according to the present invention will now be explained in more detail with reference to FIGS. 6 and 8.

Before the inflatable bag 20 is lowered into the well shaft 12, it is connected to the air hose 39 by means of the separable coupler 63 which is permanently connected to the air hose 34. A gauge 44 can be used in conjunction with the air hose 39 to indicate the pressure therein. The air hose is then connected to the compressor 36 and the entire assembly (except for the compressor 36) is then lowered into the metal casing 14 or other liner which is contained in most well shafts, to a point near the bottom thereof.

Next, the air compressor 36 is activated and the bag 20 begins to inflate. The inflatable bag 20 is used as the well plug, since it can inflate to seal wells having many different diameters. When the air pressure inside the bag 20 reaches approximately 100 psi, the bag 20, restrained from further radial expansion by the well casing 14, expands upwardly driving the loose washer 65 before it, the loose washer in turn driving the bottom edge of the coupler 63 upwardly. Because the elastomeric O-rings 64 collapse thereby permitting separation of the coupler 63 from the valve stem 22'. As this movement occurs, the valve heads 29' and 43 separate allowing the force of spring 52 to drive the valve head 48 to abut valve seat 50', thereby sealing the valve stem 22' and ensuring that the air contained in the inflatable bag 20 does not escape.

After the coupler 63 has separated from the stem 22', the air hose 39 and the coupler 63 are then removed from the well casing 14, leaving the inflatable bag 20 in situ wedged against the casing 14 or natural wall of the well shaft 12. A hardening substance such as concrete 38 or the like is then poured into the well shaft 12 until the ground level 16 has been reached, as shown in FIG. 2. This concrete permanently closes the well and also alleviates the danger of a person or an animal inadvertently stumbling into an uncovered, unattended abandoned sealed well. The concrete may also cover the area immediately surrounding the well opening thus ensuring a more permanent closure. Additionally, information such as the date that the well has been sealed can be applied into the concrete forming a permanent record of this data.

Coupler 63 can also be used to temporarily seal an opening of a operating well in order to prevent contaminated water from flowing therein, e.g. in case of a flood. As shown in FIG. 3, the inflatable bag 20 is connected to the air hose 39 by coupler 63. The inflatable bag 20 is lowered until it is only slightly below the ground level and then is inflated by use of an air compressor 36. When the bag has been inflated as to seal the well opening, the air hose 39 and the coupler 63 are disconnected from the valve stem leaving a well having a temporary seal therein. When the floodwaters have subsided, the bag is deflated by the reattachment of the air hose 39 and the coupler 63, which causes the valve head 48 to be disengaged from the valve seat 50' thereby allowing the air in the inflatable bag 20 to escape. Once the air from the bag 20 has been removed, the inflatable bag can be lifted out of the well opening to allow the normal use of the well.

The foregoing description of the specification will reveal the general nature of the invention so that others can, by applying current knowledge, rarely modify and/or adapt various applications specific embodiments without departing from the generic concept, and therefore, such adaptations and modifications should and are intended to be comprehended within the meaning and range of equivalent of the disclosed embodiment. It is to be understood that the phraseology or terminology employ herein is for the purpose of the description and not of limitations. For example, for the sake of clarity, it has been stated that the inflatable bag 20 is filled with air produced by an air compressor 36. However, it should be appreciated that any suitable fluid such as water could be used for this purpose along with any suitable supply means. Additionally, the present invention is not to be construed to be limited to sealing only water wells. Rather, this device may be utilized in sealing other types of wells or conduits having a generally circular cross-section.

I claim:

1. An apparatus for forming a seal within the wall of a well bore which comprises:

an expansible hollow member, a normally closed valve attached to said expansible member, a coupler releasably mounted on said valve and having means provided therein to hold the valve in an open position, said coupler including means for automatically disengaging said coupler from said valve when a predetermined fluid pressure is accumulated in said expansible hollow member, said means for automatically disengaging including a washer loosely mounted on said valve for aiding in the separation of said coupler from said valve, and holding means for holding said coupler and said valve together comprising at least one O-ring, and means integrally attached to said coupler for conducting a fluid under pressure to said expansible hollow member to expand said expansible hollow member against the wall of the well bore, whereby when the fluid pressure within said member reaches a predetermined value, the coupler, with the aid of said washer, will collapse said O-ring and automatically disconnect from said valve and leave said expansible member as a seal within the well bore.

2. Apparatus according to claim 1 wherein said coupler abuts against said loose washer located around said normally closed valve.

3. Apparatus according to claim 1 wherein said O-ring means includes at least one O-ring connecting said coupling to said valve, said O-ring being adapted to lose the ability to hold said coupler and said valve together at said predetermined fluid pressure thereby facilitating the release of said coupling from said value.

4. Apparatus according to claim 1 wherein said coupler is constructed of a plastic material adapted to facilitate the disengaging of said coupler from said valve at said predetermined value.

5. Apparatus according to claim 1 wherein said valve includes a valve stem being located therein, said coupler having therein connection means for connecting said coupler to said valve stem, said means for connection include depressing means for depressing said normally closed valve to said open position; and closing means provided in said valve adapted for automatic closure of said valve when said fluid pressure reaches said predetermined valve.

6. Apparatus according to claim 1 wherein said valve includes a movable valve pin having first and second heads thereon, and an annular valve stem, wherein said first head is adapted to engage a valve seat, and said coupler includes depressing means adapted to engage said second head of said movable valve pin, thereby moving said first head from said valve seat.

7. Apparatus according to claim 5 wherein said closing means includes a spring encircling a movable valve pin in an area between a valve seat and one end of said pin adapted to force another end of said pin into engagement with said seat.

8. Apparatus according to claim 5 wherein said means for automatically disengaging is constructed of a plastic material adapted to facilitate the disengaging of said coupler from said valve at said predetermined value.

9. Apparatus according to claim 1 wherein said coupler is unitary in construction.

10. In an apparatus for sealing a well bore, comprising an inflatable hollow member;

a normally closed valve attached to one end of said inflatable member;

a coupler releasably mounted on said valve and having valve opening means provided therein to hold the valve in an open position, said coupler carrying attaching means for coupling said coupler to said valve and for automatically disengaging said coupling from said valve; and hose means for conducting a fluid under pressure through said coupler and said valve to inflate said inflatable hollow member, the improvement wherein said coupler is a unitary and reusable member fixed to said hose means; said attaching means for coupling said coupler to said valve and automatically disengaging said coupler from said valve comprises at least one compressible gasket; and further comprising a loose washer disposed between said inflatable hollow member and said coupler, and axially moveable along said valve in response to inflation of said inflatable hollow member.

11. Apparatus according to claim 10 wherein said at least one compressible gasket is formed of an elastomeric material.

12. An apparatus according to claim 10 wherein said at least one compressible gasket comprises two horizontally disposed gaskets positioned opposite one another, each said gasket being straight.

13. An apparatus according to claim 1 wherein said holding means consists of two of said at least one O-ring.

14. An apparatus according to claim 13 wherein said two O-rings are disposed horizontally and positioned opposite one another, and both extend in a straight line substantially parallel to one another.

15. An apparatus according to claim 1 wherein said at least one O-ring is formed of an elastomeric material.

* * * * *